US008515330B2

(12) United States Patent
Sendo et al.

(10) Patent No.: US 8,515,330 B2
(45) Date of Patent: Aug. 20, 2013

(54) IMAGE FORMING APPARATUS WHICH MAINTAINS THE RELATIVE POSITIONAL RELATIONSHIP BETWEEN THE IMAGE FORMING SECTION AND THE SHEET DETECTION SECTION

(71) Applicants: Hiroshi Sendo, Toyokawa (JP); Yuichi Omori, Hachioji (JP)

(72) Inventors: Hiroshi Sendo, Toyokawa (JP); Yuichi Omori, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/748,310

(22) Filed: Jan. 23, 2013

(65) Prior Publication Data

US 2013/0136470 A1 May 30, 2013

Related U.S. Application Data

(62) Division of application No. 12/726,686, filed on Mar. 18, 2010.

(30) Foreign Application Priority Data

Mar. 23, 2009 (JP) ..... 2009-070861

(51) Int. Cl.
*G03G 15/00* (2006.01)
*G03G 21/00* (2006.01)

(52) U.S. Cl.
USPC ..... 399/394; 399/124

(58) Field of Classification Search
USPC ..... 399/110, 394, 124; 271/227
See application file for complete search history.

(56) References Cited

U.S. PATENT DOCUMENTS

| | | | | |
|---|---|---|---|---|
| 5,444,525 | A | 8/1995 | Takahashi et al. | |
| 5,585,889 | A | 12/1996 | Shishido et al. | |
| 5,878,318 | A | 3/1999 | Sako et al. | |
| 6,011,936 | A * | 1/2000 | Kaneko | 399/21 |
| 2006/0062589 | A1 | 3/2006 | Sasaki et al. | |
| 2007/0297821 | A1 | 12/2007 | Yamauchi et al. | |

FOREIGN PATENT DOCUMENTS

| | | | |
|---|---|---|---|
| JP | 7-77845 | A | 3/1995 |
| JP | 8-59069 | A | 3/1996 |
| JP | 2002-14500 | A | 1/2002 |

(Continued)

OTHER PUBLICATIONS

Notice of Reasons for Refusal for Japanese Patent Application No. 2009-070861, mailed Oct. 23, 2012, with English translation.

(Continued)

*Primary Examiner* — Ren Yan
*Assistant Examiner* — Blake A Tankersley
(74) *Attorney, Agent, or Firm* — Cantor Colburn LLP

(57) ABSTRACT

An image forming apparatus includes: an image forming section attached on an apparatus main body, having a forming and writing section that forms and writes an electrostatic latent image on an image carrier based on image information, and a transfer section which transfers a developed image after the electrostatic latent image has been developed, onto a sheet; a sheet conveyance section detachably attached on the apparatus main body, which conveys the sheet to the image forming section; a sheet detection section attached on the apparatus main body, which detects a sheet position conveyed to the image forming section by the sheet conveyance section; and a position correction section which corrects an image writing position for an image in the image forming section based on information of the detected sheet position.

6 Claims, 13 Drawing Sheets

(56) References Cited

FOREIGN PATENT DOCUMENTS

| | | | |
|---|---|---|---|
| JP | 2002-53240 | A | 2/2002 |
| JP | 2002-053246 | A | 2/2002 |
| JP | 2004-233712 | A | 8/2004 |
| JP | 2006-182480 | A | 7/2006 |
| JP | 2006-208847 | A | 8/2006 |
| JP | 2008-137757 | A | 6/2008 |

OTHER PUBLICATIONS

Notice of Reasons for Refusal for Japanese Patent Application No. 2009-070861, mailed Jun. 4, 2013, with English translation.

* cited by examiner

IMAGE FORMING APPARATUS WHICH MAINTAINS THE RELATIVE POSITIONAL RELATIONSHIP BETWEEN THE IMAGE FORMING SECTION AND THE SHEET DETECTION SECTION

The present application is a divisional application of U.S. patent application Ser. No. 12/726,686, filed on Mar. 18, 2010, the entire contents of which are incorporated herein by reference. The Ser. No. 12/726,686 application claimed the benefit of the date of the earlier filed Japanese Patent Application No. JP 2009-070861, filed Mar. 23, 2009, priority to which is also claimed herein, and the contents of which are also incorporated by reference herein.

BACKGROUND OF THE INVENTION

The present invention relates to an image forming apparatus that has a function to avoid image shift even when a sheet conveyance unit is drawn out of an apparatus main body for jam clearance or for apparatus maintenance and is mounted again, and is capable of being applied to a printer (a printing machine), a copying machine and a multifunction peripheral having functions of the printer and the copying machine.

In recent years, it has become popular to use image forming apparatuses such as a printer, a copying machine and a multifunction peripheral having functions of the printer and the copying machine wherein shift of the sheet to be fed to an image forming unit is detected, and an amount of shift of the sheet is fed back to the image forming unit (an image forming system) to correct a position to start writing images in the image forming system.

In relation to an image forming apparatus having a function to correct the shift of a sheet of this kind in an image forming system, there is disclosed an image forming apparatus in Unexamined Japanese Patent Application Publication No. 08-059069. This image forming apparatus detects a sheet conveyance position for a transfer sheet with a shift detection sensor, and is equipped with a memory that is capable of rewriting when storing plural sheet conveyance position data corresponding to sheet sizes, and it is one wherein sheet conveyance position data in the memory can be rewritten by key input on an operation section. When an apparatus is constructed in the aforesaid manner, a reference position of a transfer sheet in the case of sheet conveyance can be changed easily, concerning errors of mounting for a sheet conveyance unit that holds the shift detection sensor.

Further, in relation to a technology to correct an image forming position, Unexamined Japanese Patent Application Publication No. 2002-014500 discloses an image forming apparatus. In this image forming apparatus, there are provided an image carrier, a sheet conveyance device, a sheet edge detection device and a writing timing correction device, and the image carrier is given exposure, and a latent image is formed on the image carrier. The sheet conveyance device conveys a sheet to the position onto which a visible image formed on the image carrier is conveyed. A sheet edge detection device detects an edge portion of the sheet.

The writing timing correction device inputs results of detection by the sheet edge detection device to correct writing timing in the main scanning direction for the latent image formed on the image carrier. The main scanning direction is a direction that is nearly perpendicular to a conveyance direction (a sub-scanning direction) for sheets. Under the assumption of the foregoing, the sheet edge detection device detects both edges of the sheets to be conveyed. When an apparatus is constructed in the aforesaid manner, the precision in the case of lateral registration operations can be improved, which makes it possible to cope with precisions required by users flexibly.

Further, in relation to a technology to adjust registrations in the main scanning direction and sub-scanning direction, Unexamined Japanese Patent Application Publication No. 2004-233712 discloses a sheet conveyance apparatus. In this sheet conveyance apparatus, for conveying a recording sheet to an image forming section that conducts image forming on the recording sheet through a sheet conveyance path, there are provided an irradiation device, a light-receiving device and a control device, and the irradiation device is arranged on the sheet conveyance path to irradiate light that extends in the lateral direction of the recording sheet perpendicular to the conveyance direction for the recording sheet on the sheet conveyance path.

The light-receiving device is arranged to face the irradiation device with a sheet conveyance path interposed between, to receive light irradiated from the irradiation device and thereby to send out light-receiving signals corresponding to the amount of light-receiving. Under the assumption of the foregoing, the control device detects shift in lateral registration in the lateral direction, corresponding to an amount of light-receiving, and adjust image forming timing of the image forming section. Together with this, the control device detects shift of longitudinal registration in the conveyance direction for recording sheets, corresponding to the maximum amount of light-receiving an amount of a light-receiving device whose control device prescribed in advance, to control timing for start writing images of the image forming section.

When constituting in the aforesaid manner, it is possible to adjust longitudinal registration substantially for each recording sheet with a high degree of accuracy, and thereby to prescribe an image position on a recording sheet accurately.

However, an image forming apparatus wherein shift of sheet is detected, then, an amount of the shift is fed back to an image forming system and a position to start writing images is corrected, has following problems.

i. In the image forming apparatus shown in Unexamined Japanese Patent Application Publication No. 08-059069 and in Unexamined Japanese Patent Application Publication No. 2002-014500, a sheet conveyance unit (a sheet conveyance device) including a shift detection sensor (sheet reference position) is of the structure enabling the unit to be drawn out of the apparatus main body to be opened, for making JAM clearance to be easy. The JAM clearance means operations to remove sheets jammed in the image forming section for some reasons to be reluctant.

When a sheet conveyance unit including a shift detection sensor is mounted on or dismounted from the apparatus main body for JAM clearance, a position of the sheet conveyance unit for the apparatus main body is varied, and there is sometimes an occasion wherein positional shift between the adjusted conveyance reference position and a sheet conveyance unit mounting position after the JAM clearance is caused. This positional shift is sometimes fed back to the position for start writing images in the image forming system (which is also called an image forming section hereafter) to become a cause for image forming positional shift.

ii. Also in the case of mounting on and dismounting from for the sheet conveyance unit and of resetting for maintenance or the like, there is sometimes an occasion where the positional shift for the image is caused in the same way. It has been confirmed that the positional shift of an image is caused by relative positional shift between a writing unit and a shift detection sensor (which is also called a sheet detection section hereafter) caused by errors and dispersion of mounting a sheet conveyance unit. Therefore, operations of adjusting a conveyance reference position of a sheet conveyance unit for the apparatus main body are needed, each time.

iii. Even in the case where the sheet conveyance apparatus shown in Unexamined Japanese Patent Application Publication No. 2004-233712 is mounted, the problems mentioned above are still caused by the shift between the apparatus main body and the sheet conveyance unit and by the shift between the apparatus main body and the sheet conveyance unit in terms of conveyance reference position which are caused by the strain of the apparatus, generating the same image positional shift, which are caused by vibration in the case of moving the apparatus and by a difference of environment for installation of the apparatus.

Therefore, an object of the invention is to provide an image forming apparatus wherein the aforesaid problems are solved, the relative positional relationship between the image forming section and the sheet detection section can be maintained to be constant, and a position for writing images in an image forming section can be corrected more precisely in comparison with a conventional method.

SUMMARY OF THE INVENTION

One aspect of the invention is as follows.

An image forming apparatus that is characterized to have an apparatus main body section, an image forming section that is attached on the apparatus main body and has a writing section to form an electrostatic latent image on an image carrier based on image information and a transfer section that develops the electrostatic latent image formed on the image carrier and transfers the developed image onto a sheet, a sheet conveyance section that is attached on the apparatus main body to be mounted on and to be dismounted from freely, and conveys a sheet to the image forming section, a sheet detection section that is attached on the apparatus main body and detects a position of a sheet that is conveyed to the image forming section by the aforesaid sheet conveyance section and a position correction section that corrects an image writing position for images in the image forming section based on position information of the sheet detected by the sheet detection section.

Another aspect of the invention is as follow.

An image forming apparatus that is characterized to have an image forming section that is attached on the apparatus main body and conducts writing based on image information to form an electrostatic latent image on an image carrier, and develops the electrostatic latent image formed on the image carrier to transfer the developed image onto a sheet, a sheet conveyance section that is attached on the apparatus main body to be mounted on and to be dismounted from freely, and conveys a sheet to the image forming section, a sheet detection section that is attached on the apparatus main body and detects a position of a sheet that is conveyed to the image forming section by the aforesaid sheet conveyance section, and a position correction section that corrects a position for writing images in the image forming section based on information of a position of the sheet detected by the sheet detection section.

Further aspect of the invention is as follow.

An image forming apparatus that is characterized to have an image forming section that is attached on the apparatus main body and conducts writing based on image information to form an electrostatic latent image on an image carrier, and develops the electrostatic latent image formed on the image carrier to transfer the developed image onto a sheet, a sheet conveyance section that is attached on the apparatus main body to be mounted on and to be dismounted from freely, and conveys a sheet to the image forming section, a sheet detection section that is attached on the apparatus main body and detects a position of a sheet that is conveyed to the image forming section by the aforesaid sheet conveyance section, a position setting section that attached on the apparatus main body on which the image forming section is attached, and sets a position of the sheet detection section, and a position correction section that corrects a position for image writing in the image forming section based on information of the position of the sheet to be detected by the sheet detection section whose position is established by the position setting section.

Still another aspect of the invention is as follows.

An image forming apparatus that is characterized to be equipped with an image forming section that is attached at a prescribed position on the apparatus main body and forms an electrostatic latent image by writing image information on an image carrier and develops the electrostatic latent image formed on the image carrier to transfer the developed image onto a sheet, a sheet conveyance section that has a position reference section and is attached on the apparatus main body to be mounted on and to be dismounted from freely, and conveys a sheet to the image forming section, a sheet detection section that is attached on the sheet conveyance section and detects a position of a sheet that is conveyed to the image forming section by the aforesaid sheet conveyance section, a position reading section that is attached on the apparatus main body on which the image forming section is attached, and reads a position of the position reference section, and with a position correction section that corrects information of a position of the sheet to be detected by the sheet detection section based on reference position information obtained from the position reading section, and corrects a position for writing of an image in the image forming section based on information of a position of the sheet after the correction.

Still another aspect of the invention is as follows.

An image forming apparatus that is characterized to be equipped with an image forming section that is attached on the apparatus main body having a position reference section, and forms an electrostatic latent image by writing image information on an image carrier and develops the electrostatic latent image formed on the image carrier to transfer the developed image onto a sheet, a sheet conveyance section that has a position reference section and is attached on the apparatus main body on which the image forming section is attached to be mounted on and to be dismounted from freely, and conveys a sheet to the image forming section, a sheet detection section that is attached on the sheet conveyance section and detects a position of a sheet that is conveyed to the image forming section by the aforesaid sheet conveyance section, a position reading section that is attached on the sheet conveyance section on which the sheet detection section is attached, and reads a position of the position reference section of the apparatus main body section, and with a position correction section that corrects information of a position of the sheet to be detected by the sheet detection section based on reference position information obtained through reading by the position reading section, and corrects a position for writing of an image in the image forming section based on information of a position of the sheet after the correction.

BRIEF DESCRIPTION OF THE DRAWINGS

Each of FIG. 3A

Each of FIG. 5A

Each of FIG. 7A

DETAILED DESCRIPTION OF THE PREFERRED EMBODIMENT

Figure 1:
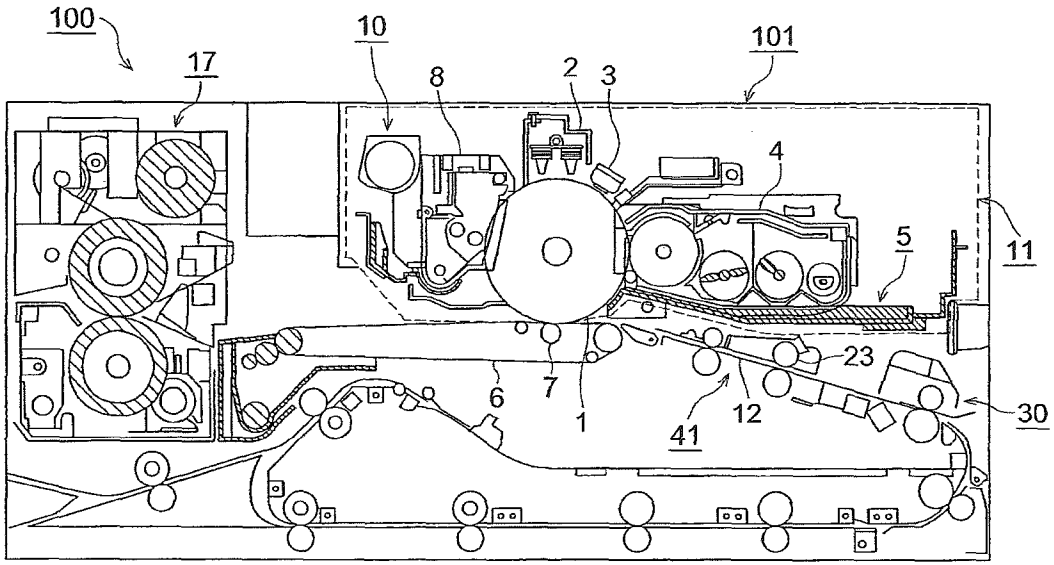
FIG. 1 is a sectional view showing an example of construction of printer 100 serving as the first Example.

An image forming apparatus relating to an embodiment of the invention will be explained as follows, referring to drawings.

Example 1

An example of construction of printer 100 serving as the first Example will be explained as follows, referring to FIG. 1 and FIG. 2. Printer 100 shown in FIG. 1 constitutes an example of an image forming apparatus, and it is equipped with a function to avoid image shift even when two-sided sheet feeding unit (which will be called ADU unit 30 hereafter) is drawn out of apparatus main body section 101 because of jam clearance or of maintenance, and the ADU unit 30 is mounted again.

In this example, the printer 100 is composed of the first shift detection mechanism 41 and apparatus main body section 101. The apparatus main body section 101 has a common member that prevents intervention of the same base member or assembling errors. The apparatus main body section 101 has therein process pedestal 11, fixing unit 17 and ADU unit 30. On the process pedestal 11, there is installed image forming unit 10 that constitutes an example of an image forming section.

The image forming unit 10 is composed of drum cartridge 5 and transfer unit 7. The drum cartridge 5 is composed of photoconductor drum 1, charging unit 2, writing unit 3, developing unit 4 and drum cleaner 8. On the outer circumference of the photoconductor drum 1, there are arranged, for example, charging unit 2, writing unit 3, developing unit 4, transfer unit 7 and drum cleaner 8.

The charging unit 2 is arranged at a prescribed position on the outer circumferential portion of the photoconductor drum 1, and it electrifies uniformly the photoconductor drum 1 which has been cleaned. On the outer circumferential portion of the photoconductor drum 1 to which the charging unit 2 is adjacent, there is arranged writing unit 3 irradiates a laser beam having prescribed intensity based on image information on the photoconductor drum 1 charged uniformly, to operate for writing an electrostatic latent image. The writing unit 3 is positioned on the drum cartridge 5.

On the photoconductor drum 1, there is formed an electrostatic latent image. The developing unit 4 has therein black toner agents, and it develops the electrostatic latent image formed on the photoconductor drum 1 with toner agents. On the photoconductor drum 1, there is formed a black toner image. The transfer unit 7 transfers the toner image formed on the photoconductor drum 1 onto sheet P that is an example of sheet. The drum cleaner 8 operates to clean (remove) toner agents which are remaining on the photoconductor drum 1.

The fixing unit 17 is arranged at the downstream side of the transfer unit 7 that is adjacent to the drum cartridge 5. The fixing unit 17 fixes an image transferred onto sheet P, and ejects the sheet P that has been fixed. The downstream side in this case implies the side where the transferred sheet P is ejected from the transfer unit 7, under the assumption that the side where sheet P is fed to the transfer unit 7 is the upstream side. The transfer unit 7 is connected to the fixing unit 17 through sheet conveyance belt 6.

ADU unit 30 constituting an example of a sheet conveyance section is mounted to be capable of being mounted on and dismounted from freely on apparatus main body section 101 on which the aforesaid image forming unit 10 is installed. The ADU unit 30 is in the structure wherein the ADU unit 30 can be drawn out of the apparatus main body section 101 in the case of jamming clearance or of maintenance work, and can be mounted on the apparatus main body section 101 again. The ADU unit 30 operates to convey sheet P to the image forming unit 10 from an unillustrated sheet feeding section, and to feed a sheet again to image forming unit 10 by reversing the sheet P on which an image has been formed.

Figure 2:
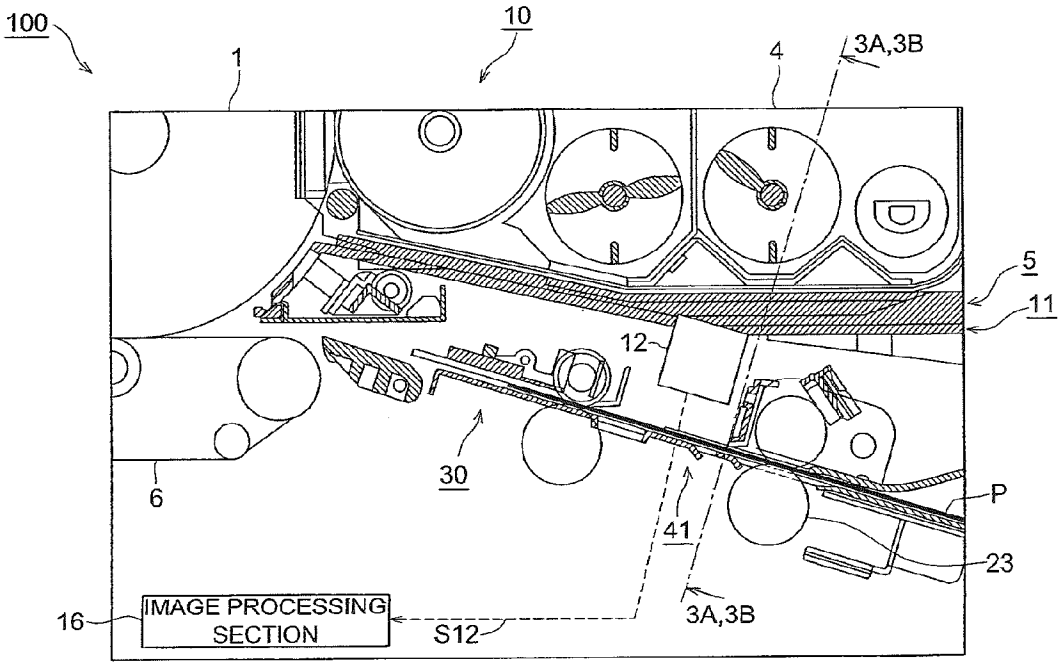
FIG. 2 is an enlarged diagram showing an example of construction of first detection mechanism 41.

In this example, the printer 100 has the first shift detection mechanism 41 shown in FIG. 2. The shift detection mechanism 41 is composed of shift detection sensor 12 that constitutes an example of a sheet detection section. For example, the shift detection sensor 12 is attached so that it may be fixed solidly on drum cartridge 5.

The shift detection sensor 12 detects a position (sheet conveyance position) of sheet P conveyed by ADU unit 30 to the image forming unit 10 from an unillustrated sheet feeding section, and outputs sheet detection signals S12 to image processing section 16. For the shift detection sensor 12, a line sensor wherein photoelectric conversion elements are arranged to be in the state of lines is used. For the shift detection sensor 12, it is also possible to use an image sensor wherein photoelectric conversion elements are arranged to be in the shape of matrix, in addition to the line sensor.

In this example, dispersion of a position between writing unit 3 (see FIG. 1) and the shift detection sensor 12 is not caused in the drum cartridge 5, because the shift detection sensor 12 is fixed on the drum cartridge 5 solidly. Whereby, a relative position between the writing unit 3 and the shift detection sensor 12 is kept to be constant and shift of image position is not caused, even when a position of ADU 30 is scattered in the case of jamming clearance or removing of ADU unit 30.

The image processing section 16 constitutes an example of a position correction section, and it corrects an image writing position in the image forming unit 10 based on information of the position of sheet P detected by the shift detection sensor 12. In this example, when writing unit 3 irradiates a laser beam having prescribed intensity based on image information on photoconductor drum 1 to write an electrostatic latent image, a position to start writing is adjusted.

For example, when sheet P is shifted to the left side for the sheet conveyance direction, a position to start writing is corrected (to be earlier) by an amount of shifting, compared with an occasion of no shifting, thus, writing unit 3 irradiates a laser beam on photoconductor drum 1 to start writing image information. Further, when sheet P is shifted to the right side for the sheet conveyance direction, a position to start writing is corrected (to be later: delaying in the main scanning direction) by an amount of shifting, compared with an occasion of no shifting, thus, writing unit 3 irradiates a laser beam on photoconductor drum 1 to start writing image information.

Next, an example of operations of the first shift detection mechanism 41 will be explained as follows, referring to FIG. 3A and FIG. 3B. The first shift detection mechanism 41 shown in FIG. 3A is in the state prior to mounting of ADU unit 30, and it is the state wherein ADU unit 30 is drawn out.

Figure 3A:
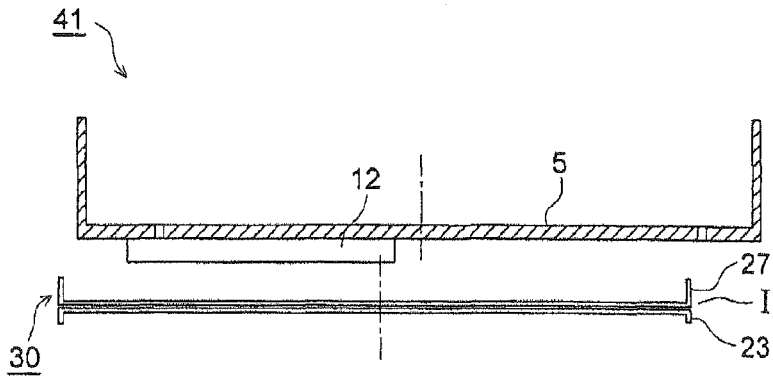
FIG. 3B is a sectional view taken on line 3A-3A (3B-3B) in FIG. 2 showing an example of operations of the first shift detection mechanism 41.

The shift detection sensor 12 shown in FIG. 3A is fixed on the reverse surface side of drum cartridge 5 solidly. Since the shift detection sensor 12 is fixed on drum cartridge 5 solidly, it does not include main causes for positional shift for a separation structure.

Figure 3B:
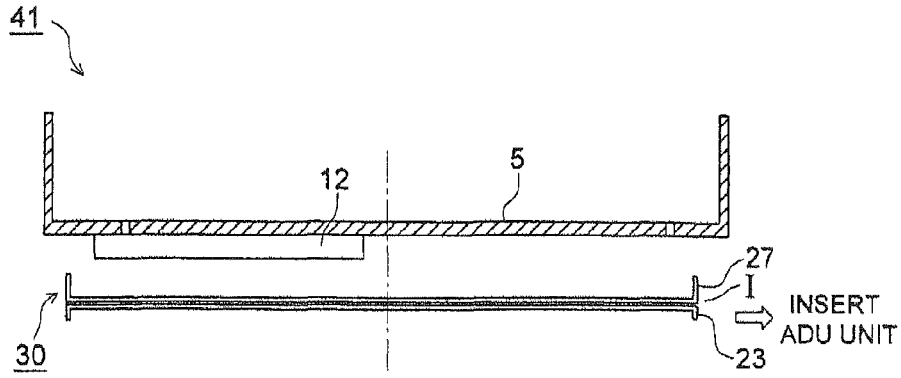

The first shift detection mechanism 41 shown in FIG. 3B is in the state after the mounting of ADU unit 30. Since the shift detection sensor 12 is fixed on drum cartridge 5 solidly, it detects a sheet conveyance position without including main causes for positional shift for a storage structure after installation of ADU unit 30 on apparatus main body section 101.

Since the writing unit 3 of the image forming unit 10 and shift detection sensor 12 on the reverse surface side of drum cartridge 5 are controlled in terms of a mathematical operation by the same coordinates system, the relative position relationship between the writing unit 3 and the shift detection sensor 12 can be held to be constant.

In the printer 100 representing the first example, the first shift detection mechanism 41 is provided, and writing unit 3 that is equipped with the first shift detection mechanism 41 and forms an electrostatic latent image by writing image information on photoconductor drum 1 and shift detection sensor 12 that detects a position of sheet P are attached and fixed on drum cartridge 5 solidly, the relative position relationship between the writing unit 3 and the shift detection sensor 12 can be held to be constant.

Therefore, in jamming clearance for paper jam, even when a position of installation of ADU unit 30 on apparatus main body section 101 is scattered, it is possible to correct a writing position for an image on image forming unit 10 with a higher degree of accuracy, in comparison with a conventional mode. In addition, even when a positional shift is caused between apparatus main body section 101 and ADU unit 30 by an error of attaching ADU unit 30 on the apparatus main body section 101 in the case of maintenance or the like, it is not necessary to adjust again for correction of image positions.

Though an explanation has been given in the present example for the occasion wherein shift detection sensor 12 is mounted on drum cartridge 5 that houses therein writing unit 3, the same effects can be achieved by attaching and fixing shift detection sensor 12 together with writing unit 3 solidly, when the drum cartridge 5 and the writing unit 3 are structured separately.

Example 2

Figure 4:
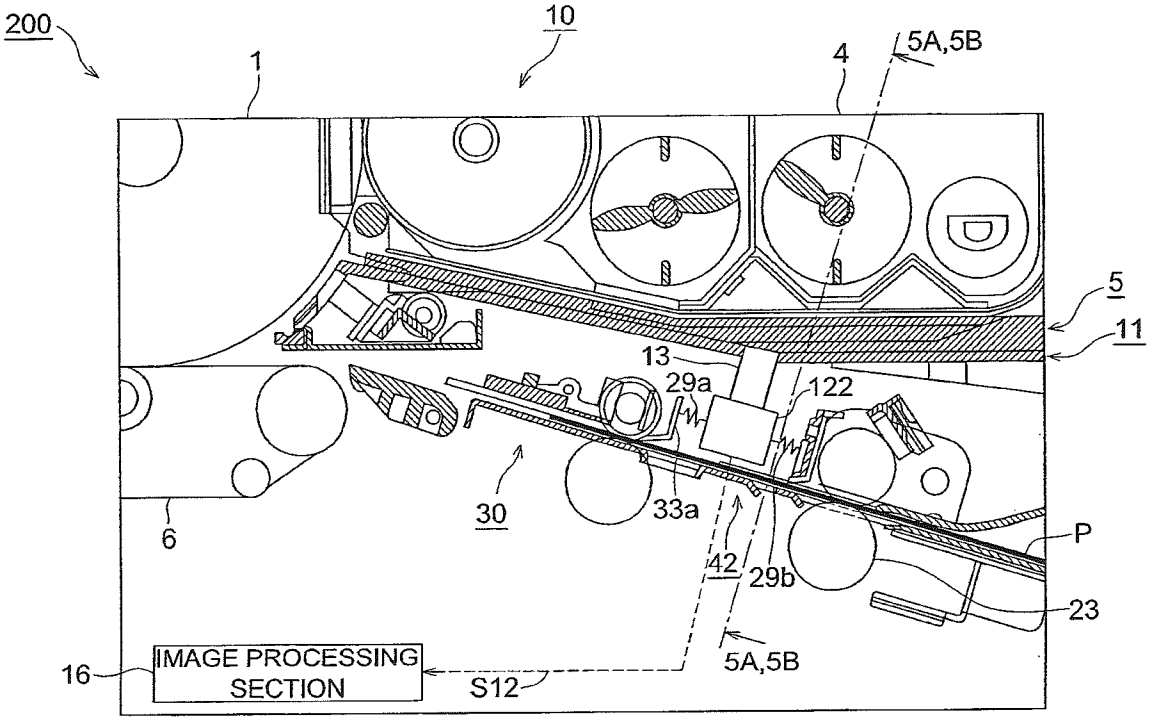
FIG. 4 is a sectional view showing an example of construction of printer 200 serving as the second Example.

Next, printer 200 serving as the second Example will be explained as follows, referring to FIG. 4. The printer 200 shown in FIG. 4 constitutes an example of an image forming apparatus, and it is one equipped with a function that does not cause image shifting even when ADU unit 30 is drawn out of apparatus main body section 101 shown in FIG. 1 in the case of jamming clearance or maintenance work, and then the ADU unit 30 is installed again.

In the present example, there is employed a construction wherein a position reference section (hereinafter referred to as stopper section 13) serving as a sheet conveyance reference position is provided on drum cartridge 5 on which writing unit 3 is attached, and shift detection sensor 122 attached to be capable of swinging freely is positioned by the stopper section 13.

The printer 200 is composed of the second shift detection mechanism 42 and apparatus main body section 101. The apparatus main body section 101 has therein process pedestal 11, fixing unit 17 and ADU unit 30, and image forming unit 10 is attached on the process pedestal 11. The image forming unit 10 has therein drum cartridge 5 and transfer unit 7. The drum cartridge 5 is composed of charging unit 2, photoconductor drum 1, writing unit 3, developing unit 4 and of drum cleaner 8.

The ADU unit 30 is easily attached on and removed from the apparatus main body section 101 on which the aforesaid image forming unit 10 is attached. The ADU unit 30 has a structure wherein the ADU unit 30 is drawn out of the apparatus main body section 101 in the case of jamming clearance or maintenance work, and is installed again on the apparatus main body section 101. The ADU unit 30 operates to convey sheet P to image forming unit 10. Incidentally, items having symbols and names which are the same as those in the Example 1 are omitted in terms of explanation, because they have the same functions.

Even in the present example, there is employed a construction wherein a positional shifting between the writing unit 3 and the shift detection sensor 122 is not caused. The printer 200 has the second shift detection mechanism 42. The second shift detection mechanism 42 is composed of stopper section 13 and shift detection sensor 122.

The shift detection sensor 122 is positioned by the stopper section 13, and is supported by ADU unit 30 to be capable of swinging freely. For example, the shift detection sensor 122 is supported by a pair of supporting members 33*a* and 33*b* embedded on the ADU unit 30 to be capable of swinging freely.

In the present example, an urging member such as spring 29*a* (coil spring) is arranged between supporting member 33*a* and one side of the shift detection sensor 122. In the same way, spring 29*b* is arranged between supporting member 33*b* and the other side of the shift detection sensor 122. The shift detection sensor 122 is supported to be capable of swinging freely through these urging members, and it hits the stopper section 13 to maintain its posture when the ADU unit 30 is installed onto apparatus main body section 101.

Stopper section 13 constitutes an example of a position setting section, and is attached on process pedestal 11 on which image forming unit 10 is attached. A projection member is used for the stopper section 13. The stopper section 13, for example, is provided on the side from which the ADU unit 30 is viewed and on the reverse surface side of drum cartridge 5 on which the writing unit 3 is attached. A position for the stopper section 13 to be attached is a position where an amount of positional shift between writing unit 3 and ADU unit 30 is zero.

The stopper section 13 provided on the reverse surface side of the drum cartridge 5 functions so that a position of the shift detection sensor 122 may be established (determined). A metal piece or a resin piece having a prescribed size and a prescribed length is used for the stopper section 13. The stopper section 13 can be anything provided that it can serve as a member to determine a position for the shift detection sensor 122.

In this example, dispersion of a position between writing unit 3 and the shift detection sensor 12 is not caused in the drum cartridge 5, because the shift detection sensor 122 hits the stopper section 13 to maintain the posture. Owing to this, relative position between the writing unit 3 and the shift detection sensor 122 is kept to be constant and shift of image position is not caused, even when a position of ADU 30 is scattered in the case of jamming clearance or removing of ADU unit 30.

The shift detection sensor 122 detects a sheet conveyance position for sheet P conveyed by ADU unit 30 to image forming unit 10 from a sheet feeding section, and outputs sheet detection signals S12 to image processing section 16. The image processing section 16 corrects an image writing position in image forming unit 10 based on positional information of sheet P detected by the shift detection sensor 122 whose position is established by stopper section 13. Contents of the correction are the same as those in the Example 1.

Figure 5A:
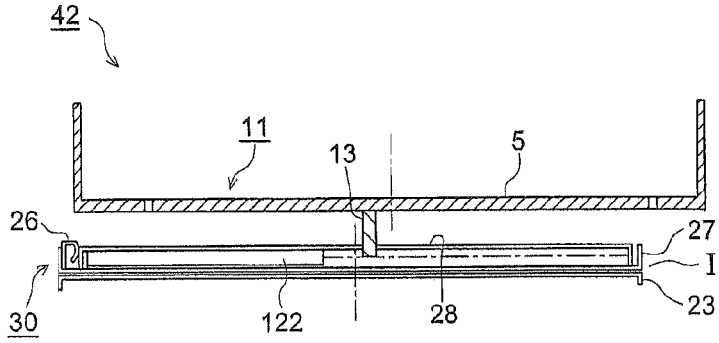
FIG. 5B is a sectional view taken on line 5A-5A (5B-5B) in FIG. 4 showing an example of operations of the second shift detection mechanism 42.
Figure 5B:
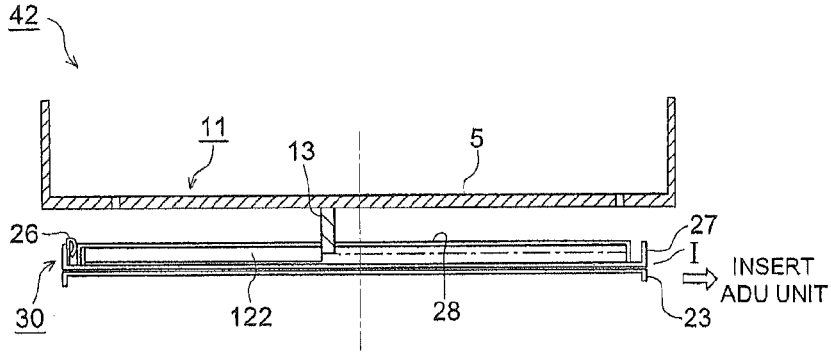

Next, an example of operations of the second shift detection mechanism 42 will be explained as follows, referring to FIGS. 5A and 5B. In FIGS. 5A and 5B, springs 29*a* and 29*b* are not illustrated. In the present example, there is employed a structure wherein stopper section 13 is provided on drum cartridge 5 on which writing unit 3 is attached, and the shift detection sensor 122 attached to be capable of swinging freely is positioned by the stopper section 13 (second shift detection mechanism).

The second shift detection mechanism 42 shown in FIG. 5A is in the state before installation of the ADU unit 30, and in the state where the ADU unit 30 has been drawn out of drum cartridge 5 of the image forming unit 10. The ADU unit 30 to be installed on apparatus main body section 101 has registration roller 23, ADU main body section 27 and slide chassis 28. Sheet-passing surface I is established in a space between the ADU main body section 27 and the registration roller 23, and sheet P is conveyed to the sheet-passing surface I.

The shift detection sensor 122 shown in FIG. 5A is fixed on the ADU unit 30 to be capable of swinging freely. Stopper section 13 that is hit by the shift detection sensor 122 is attached on the apparatus main body section 101 on which the image forming unit 10 is attached. In this example, the stopper section 13 is provided on the side that is a reverse surface side of drum cartridge 5 on which the writing unit 3 is attached from which the ADU unit 30 is viewed.

The second shift detection mechanism 42 shown in FIG. 5B is in the state after installation of the ADU unit 30, and in the state where the ADU unit 30 has been installed on drum cartridge 5 of the image forming unit 10. The shift detection sensor 122 of the ADU unit 30 hits the stopper section 13 to be fixed. As a result, the ADU unit 30 is maintained in the state wherein the ADU unit 30 is fixed on the apparatus main body section 101.

Since the shift detection sensor 122 is fixed on the drum cartridge 5 by the stopper section 13 and by urging force of a leaf spring, it turns out to be capable of detecting a sheet conveyance position without including main causes for positional shift for a storage structure after installation of ADU unit 30 on drum cartridge 5 of image forming unit 10. The leaf spring 26 can be omitted if urging force of leaf spring 29*a* that supports the shift detection sensor 122 to swing is available.

Owing to this, the writing unit 3 of the image forming unit 10 and shift detection sensor 122 on the reverse surface side of drum cartridge 5 are controlled in terms of a mathematical operation by the same coordinates system. Therefore, the relative position relationship between the writing unit 3 and the shift detection sensor 122 can be held to be constant.

In the printer 200 representing the second example, the second shift detection mechanism 42 is provided, then, stopper section 13 is attached on drum cartridge 5 on which writing unit 3 is mounted, and the stopper section 13 establishes a position of the shift detection sensor 122 that is supported to be capable of swinging freely for ADU unit 30, for the process pedestal 11.

In the example mentioned above, when the ADU unit 30 is installed again after the end of jamming clearance, the shift detection sensor 122 hits stopper section 13 provided on the reverse surface side of drum cartridge 5 to be positioned. Therefore, this positioning can hold relative position relationship between image forming unit 10 and shift detection sensor 122 to be constant, even when the relative position of the ADU unit 30 is shifted in the case of jamming clearance or of removing of the ADU unit 30.

Owing to this, even when a position of installation of the ADU unit 30 for apparatus main body section 101 is scattered in the case of jamming clearance or the like, a position for writing of images in image forming unit 10 can be corrected with a higher degree of accuracy, compared with a conventional method. In addition, even when a positional shift is caused between apparatus main body section 101 and ADU unit 30 by an error of installation of ADU unit 30 on the apparatus main body section 101, a correction of an image position does not need to be adjusted again.

Example 3

Figure 6:
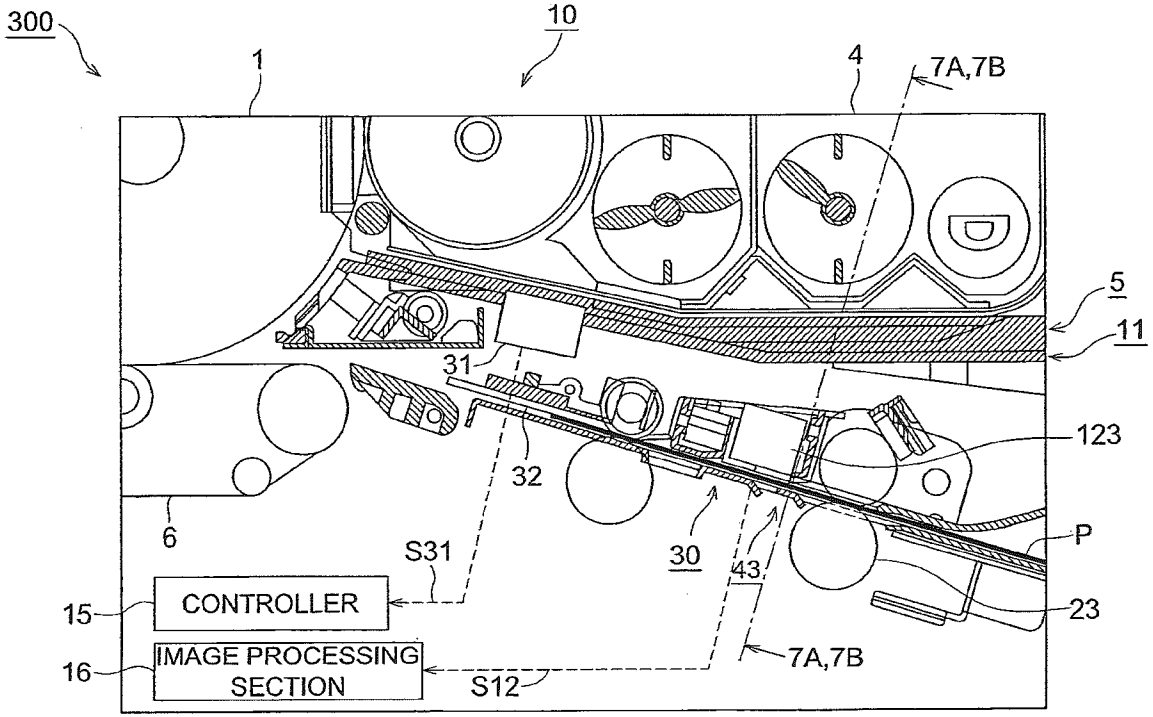
FIG. 6 is a sectional view showing an example of construction of printer 300 serving as the third Example.

Next, printer 300 representing the third example will be explained as follows, referring to FIG. 6. The printer 300 shown in FIG. 6 constitutes an example of an image forming apparatus, and it is equipped with a function that does not cause image shifting even when ADU unit 30 is drawn out of apparatus main body section shown in FIG. 1, in the case of jamming clearance or of maintenance work, and is installed again.

In this example, there is employed a construction wherein a relative position between apparatus main body section 101 on which writing unit 3 is attached and ADU unit 30 is detected by position reading section 31, and an amount of positional shift between the ADU unit 30 and the writing unit 3 is calculated to correct image writing timing so that an amount of this positional shift may be eliminated.

The printer 300 is composed of the third shift detection mechanism 43 and apparatus main body section 101. The apparatus main body section 101 has process pedestal 11, fixing unit 17 and ADU unit 30, and image forming unit 10 is attached on the process pedestal 11. The image forming unit 10 is composed of drum cartridge 5 and transfer unit 7. The drum cartridge 5 is composed of charging unit 2, photoconductor drum 1, writing unit 3, developing unit 4 and of drum cleaner 8.

The ADU unit 30 is attached detachably on the apparatus main body section 101 on which the aforesaid image forming unit 10 is attached. The ADU unit 30 has a structure wherein the ADU unit 30 can be installed again on the apparatus main body section 101 after the ADU unit 30 is drawn out of apparatus main body section 101 shown in FIG. 1 in the case of jamming clearance or of maintenance work. The ADU unit 30 operates to convey sheet P to the image forming unit 10. Incidentally, items having symbols and names which are the same as those in the first example are omitted in terms of explanation because they have the same functions.

In this example, the ADU unit 30 has position reference section 32. The position reference section 32 is a portion on which a conveyance reference position of sheet P is described, and for example, it is one on which a white line is shown on a black background. The ADU unit 30 is attached on apparatus main body section 101 on which the image forming unit 10 is attached to be capable of being mounted on and dismounted from freely, and conveys sheet P to image forming unit 10.

Position reading section 31 is attached on apparatus main body section 101 on which the image forming unit 10 is attached, to read a position of position reference section 32. The position reference section 32 is one that becomes a unit position detection reference on ADU unit 30. For position reading section 31, a CCD image pickup device is used, and for example, it picks up an image of position reference section 32 on which a white line is shown on a black background, and it outputs reference position signal S31 (reference position information) to controller 15.

Shift detection sensor 123 is attached on ADU unit 30, and it detects a sheet conveyance position for sheet P conveyed to image forming unit 10 from a sheet supply section by the ADU unit 30, and outputs sheet detection signals S12 to image processing section 16. The controller 15 operates to correct sheet detection signals S12 obtained from shift detection sensor 123 based on reference position signals S31 obtained from position reading section 31.

Next, an example of operations of the third shift detection mechanism 43 will be explained as follows, referring to FIGS. 7A and 7B. In this example, there is employed a construction wherein a relative position between apparatus main body section 101 and ADU unit 30 is detected with position reading section 31, and an amount of positional shift between ADU unit 30 and writing unit 3 is calculated to correct a position to start writing so that an amount of this positional shift may be eliminated.

Figure 7A:
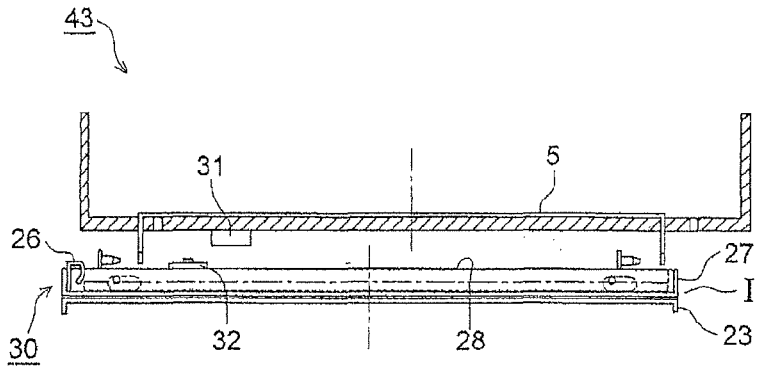
FIG. 7B is a sectional view taken on line 7A-7A (7B-7B) in FIG. 6 showing an example of operations of the third shift detection mechanism 43.
Figure 7B:
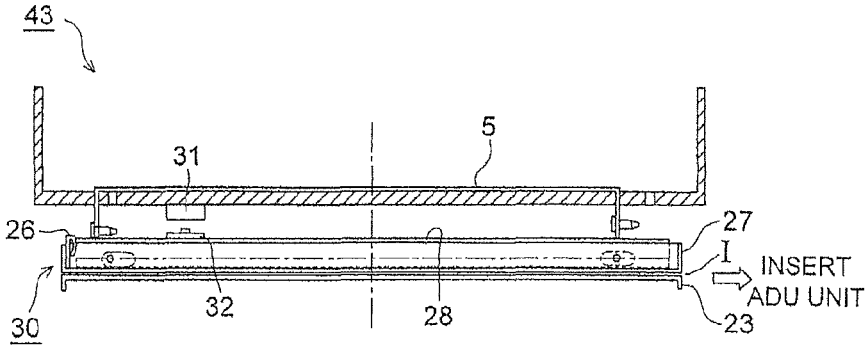

The third shift detection mechanism 43 shown in FIG. 7B is in the state before installation of the ADU unit 30, and is in the state where the ADU unit 30 has been drawn out of drum cartridge 5 of the image forming unit 10. In this example, ADU unit 30 that is installed on apparatus main body section 101 has therein registration roller 23, ADU main body section 27 and slide chassis 28. Sheet-passing surface I is established in a space between the ADU main body section 27 and the registration roller 23, and sheet P is conveyed to the sheet-passing surface I.

Shift detection sensor 123 shown in FIG. 7A is fixed on the slide chassis 28 of the ADU unit 30 in the same way as in the conventional method. Position reference section 32 is attached on the slide chassis 28 on ADU main body section 27 on which shift detection sensor 123 is fixed. Position reference section 32 is arranged at the position that is within a visual field of position reading section 31 when ADU unit 30 is installed.

The third shift detection mechanism 43 shown in FIG. 7B is in the state after installation of the ADU unit 30, and in the state where the ADU unit 30 has been installed on apparatus main body section 101 on which drum cartridge 5 is attached. Position reference section 32 of ADU unit 30 is fixed in the visual field.

Since the shift detection sensor 123 is fixed on drum cartridge 5 solidly by urging force of leaf spring 26, a sheet conveyance position can be detected without including main causes for positional shift for a storage structure after installation of ADU unit 30 on drum cartridge 5 of image forming unit 10.

Owing to this, the relative position relationship between apparatus main body section 101 on which the writing unit 3 is attached and the shift detection sensor 123 can be held to be constant. Therefore, the writing unit 3 of the image forming unit 10 and shift detection sensor 123 on the reverse surface side of drum cartridge 5 can be controlled in terms of a mathematical operation by the same coordinates system, under the condition that these relative position relationships are held to be constant.

Figure 8:
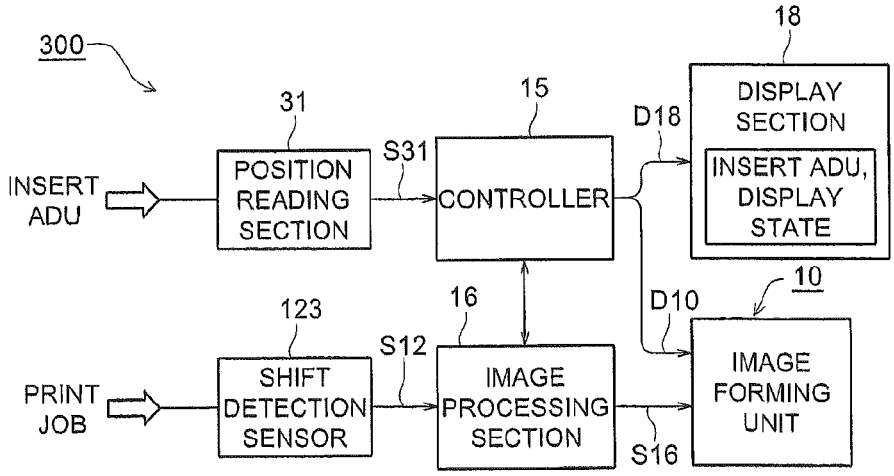
FIG. 8 is a block diagram showing an example of construction of a control system of printer 300.

Next, an example of the construction of a control system of printer 300 will be explained as follows, referring to FIG. 8. The control system of printer 300 shown in FIG. 8 is composed of image forming unit 10, controller 15, image processing section 16, display section 18, position reading section 31 and of shift detection sensor 123.

In this example, image forming unit 10 is connected to controller 15, and image forming unit 10 inputs image information D10 from controller 15 and inputs writing control signals S16 from image processing section 16 to form an image on prescribed sheet P (see FIG. 1).

Position reading section 31 is connected to controller 15, to pick up images of position reference section 32 wherein a white line is shown on a black background, and outputs reference position signals S31 (reference position information) to controller 15. Shift detection sensor 123 is connected to image processing section 16, to detect a sheet conveyance position for sheet P that is conveyed to image forming unit 10 from an unillustrated sheet feeding section, and output sheet detection signals S12 to image processing section 16.

The image processing section 16 is connected to controller 15 to input sheet detection signals S12 from the shift detection sensor 123, and for example, the image processing section 16 carries out image processing such as extraction of an edge of sheet P. The image processing section 16 detects a shift of sheet P by image processing such as extraction of an edge of sheet P, and calculates correction data in the case of image writing out to output them to image forming unit 10.

When a positional shift is caused between a comparison reference position established on position reading section 31 and a conveyance reference position shown by a white line of position reference section 32, for example, the controller 15 acquires an amount of positional shift between the comparison reference position of position reading section 31 and the position of the white line of the position reference section 32, based on the reference position signals S31 obtained from the position reading section 31.

When the comparison reference position of the position reading section 31 agrees with the position of the white line of the position reference section 32, an amount of positional shift is zero. When the position of the white line of the position reference section 32 is shifted to the back side on the page space (to the one side in the main scanning direction) for the comparison reference position of the position reading section 31 in this example, the controller 15 calculates a minus amount of positional shift that is equivalent to a difference between the comparison reference position of the position reading section 31 and the position of the white line of the position reference section 32.

Further, when the position of the white line of the position reference section 32 is shifted to front side on the page space (to the other side in the main scanning direction) for the comparison reference position of the position reading section 31, the controller 15 calculates a plus amount of positional shift that is equivalent to a difference between the comparison reference position of the position reading section 31 and the position of the white line of the position reference section 32. The controller 15 adds the "plus or minus (±)" amount of positional shift to correction processing for writing position by shift detection sensor 123 in the conventional method.

For example, the controller 15 transmits a plus or minus amount of positional shift to image processing section 16. The image processing section 16 inputs the plus or minus amount of positional shift to carry out correction processing. In the image processing section 16, the plus or minus amount of positional shift are added to sheet detection signals S12. This addition processing is an arithmetic processing wherein errors of attaching ADU unit 30 on apparatus main body section 101 are deducted from sheet detection signals S12.

Through this arithmetic processing, a relative position between ADU unit 30 and image forming unit 10 is corrected. The image processing section 16 corrects a position for writing images in image forming unit 10 based on information of a position of sheet P after the correction.

For example, when sheet P is shifted to the back side on the page space for the sheet conveyance direction, writing control signals S16 is corrected so that a position to start writing may be shifted to the front side (may be made to be earlier) by an amount equivalent to an amount of shifting, compared with an occasion where no shifting is caused. On the image forming unit 10, writing unit 3 shown in FIG. 1 is made to input writing control signals S16, then, to irradiate a laser beam on photoconductor drum 1 and to start writing image information D10.

Further, when sheet P is shifted to the front side on the page space for the sheet conveyance direction, writing control signals S16 is corrected so that a position to start writing may be shifted to the back side (may be made to be delayed) by an amount equivalent to an amount of shifting, compared with an occasion where no shifting is caused. On the image forming unit 10, writing unit 3 shown in FIG. 1 is made to input writing control signals S16, then, to irradiate a laser beam on photoconductor drum 1 and to start writing image information D10.

In the printer 300 representing the third example, the third shift detection mechanism 43 is provided, position reading section 31 is attached on process pedestal 11 on which image forming unit 10 is attached, the position reading section 31 reads a position of reference section 32 on which a white line is shown on a black background, controller 15 corrects a relative position between ADU unit 30 and image forming unit 10 based on reference position signals S31 obtained from position reading section 31, and image processing section 16 corrects information of sheet conveyance position for sheet P detected by shift detection sensor 123 based on a plus or minus amount of positional shifting.

Therefore, it turns out to be possible to carry out arithmetic processing to deduct errors of attaching ADU unit 30 on apparatus main body section 101 from sheet detection signals S21 obtained from shift detection sensor 123 in the conventional structure. As a result, it becomes possible to correct positional shifting caused unwillingly between image forming unit 10 and shift detection sensor 123.

Due to the foregoing, it becomes possible to correct an image writing position on image forming unit 10 with a higher degree of accuracy, in comparison with a conventional mode, even when a position of installation of ADU unit 30 on apparatus main body section 101 is scattered, in case of jamming clearance or of removal of ADU unit 30. In addition, even when a positional shift is caused between apparatus main body section 101 on which process pedestal is attached and ADU unit 30 by an error of attaching ADU unit 30 on the apparatus main body section 101 in the case of maintenance or the like, it is not necessary to adjust again for correction of image positions.

Figure 12:
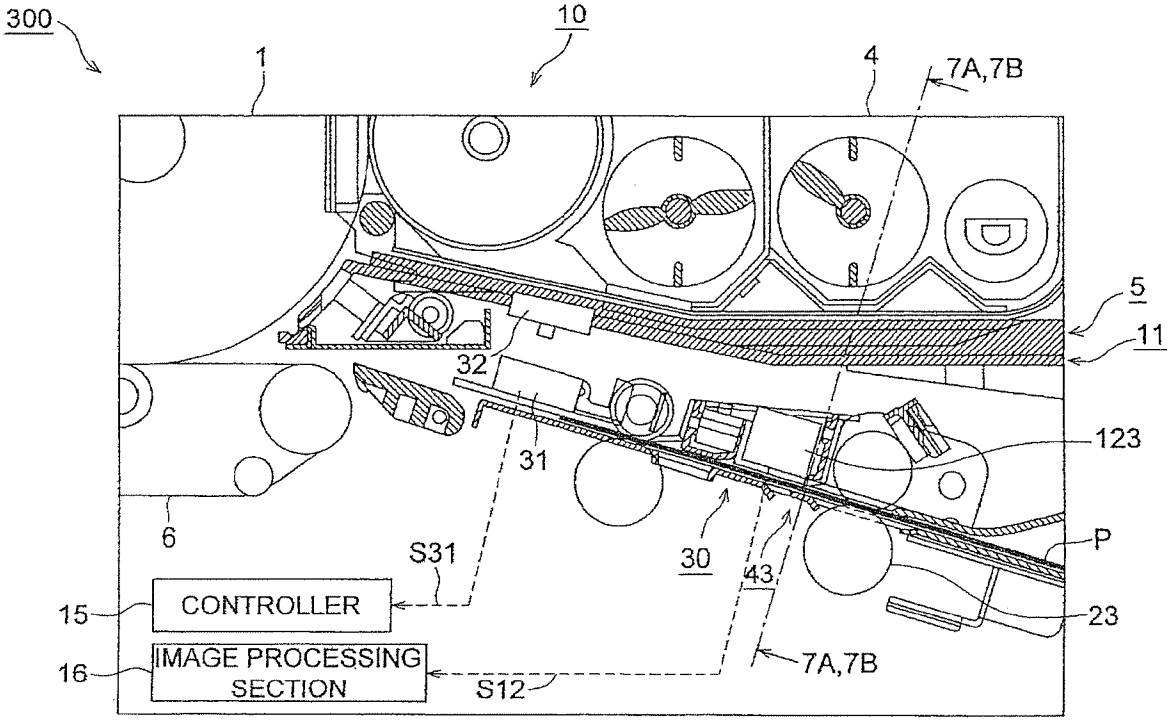
FIG. 12 is a section view showing an example of construction of a printer according to at least an embodiment.
Figure 13A:
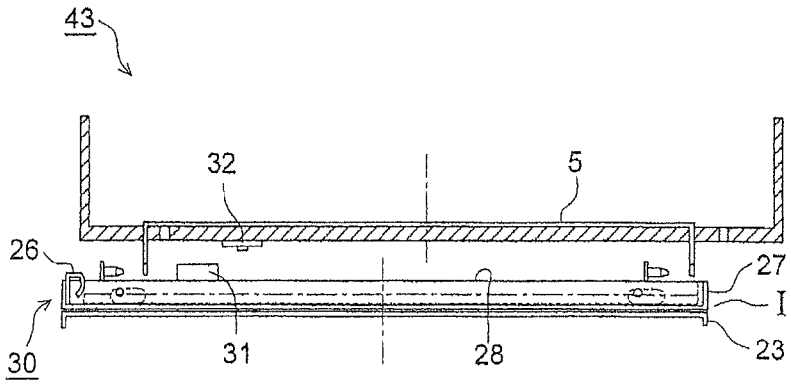
FIGS. 13A and 13B are section views taken on line 7A-7A (7B-7B) of FIG. 12 showing an example of operations of the third shift detection mechanism 43.
Figure 13B:
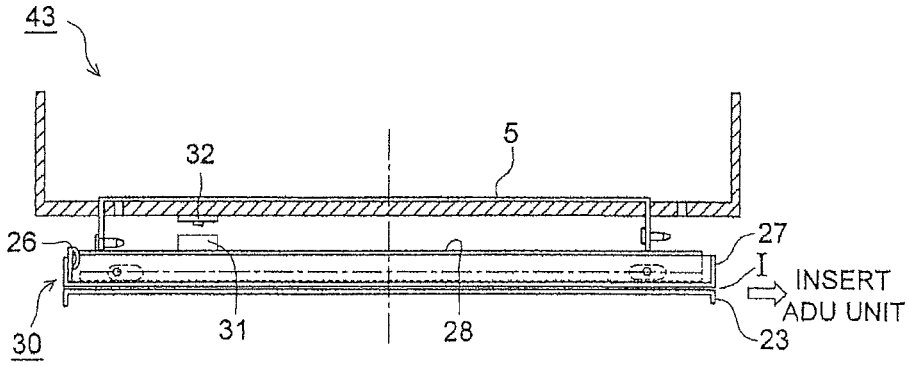

Though there has been shown an example to provide position reference section 32 on the ADU unit 30 side and to provide position reading section 31 on the reading side in the third example, the invention is not limited to the foregoing, and, as shown in FIGS. 12, 13A, and 13B, the same effects can be obtained even when providing position reading section 31 on the ADU unit 30 side and providing position reference section 32 on the image forming unit 10 side.

Further, although the explanation has been given for the method to share correction processing by controller 15 and by image processing section 16, the invention is not limited to this, and it is possible to employ a method wherein the controller 15 corrects a relative position between ADU unit 30 and image forming unit 10 based on reference position signals S31 obtained from position reading section 31, and the controller 15 corrects information of sheet conveyance position for sheet P detected by shift detection sensor 123 based on plus or minus (±) amount of positional shifting.

Example 4

Next, printer 400 representing the fourth example will be explained as follows, referring to FIGS. 9-11. The printer 400 shown in FIG. 9 constitutes an example of an image forming apparatus, and it is equipped with controller 15 that distinguishes the quality of insertion and locking when drawing out ADU unit 30 from apparatus main body section 101 shown in FIG. 1 and installing ADU unit 30 again in the case of jamming clearance and maintenance work. In addition, there is no exclusive sensor for monitoring insertion and locking, and shift detection sensor 124 having a function of shift detection exhibits also function for insertion and monitoring.

The printer 400 is composed of shift detection mechanism 44 and of apparatus main body section 101. The apparatus main body section 101 has therein process pedestal 11, fixing unit 17 and ADU unit 30, and image forming unit 10 is attached on the apparatus main body section 101. The image forming unit 10 is composed of drum cartridge 5 and transfer unit 7. The drum cartridge 5 is composed of charging unit 2, photoconductor drum 1, writing unit 3, developing unit 4 and drum cleaner 8.

ADU unit 30 is attached detachably on apparatus main body section 101 on which the aforesaid image forming unit 10 is attached. The ADU unit 30 has a structure wherein it can be drawn out of apparatus main body section 101 shown in FIG. 1 in the case of jamming clearance and maintenance work, and can be installed on the apparatus main body section 101 again. The ADU unit 30 operates to convey sheet P to image forming unit 10. Incidentally, items having symbols and names which are the same as those in the Example 1 are omitted in terms of explanation, because they have the same functions.

Next, an example of the structure of the control system of the printer 400 will be explained as follows, referring to FIG. 10. The control system of the printer 400 shown in FIG. 1 is composed of image forming unit 10, controller 15, image processing section 16, display section 18 and shift detection sensor 124.

Figure 9:
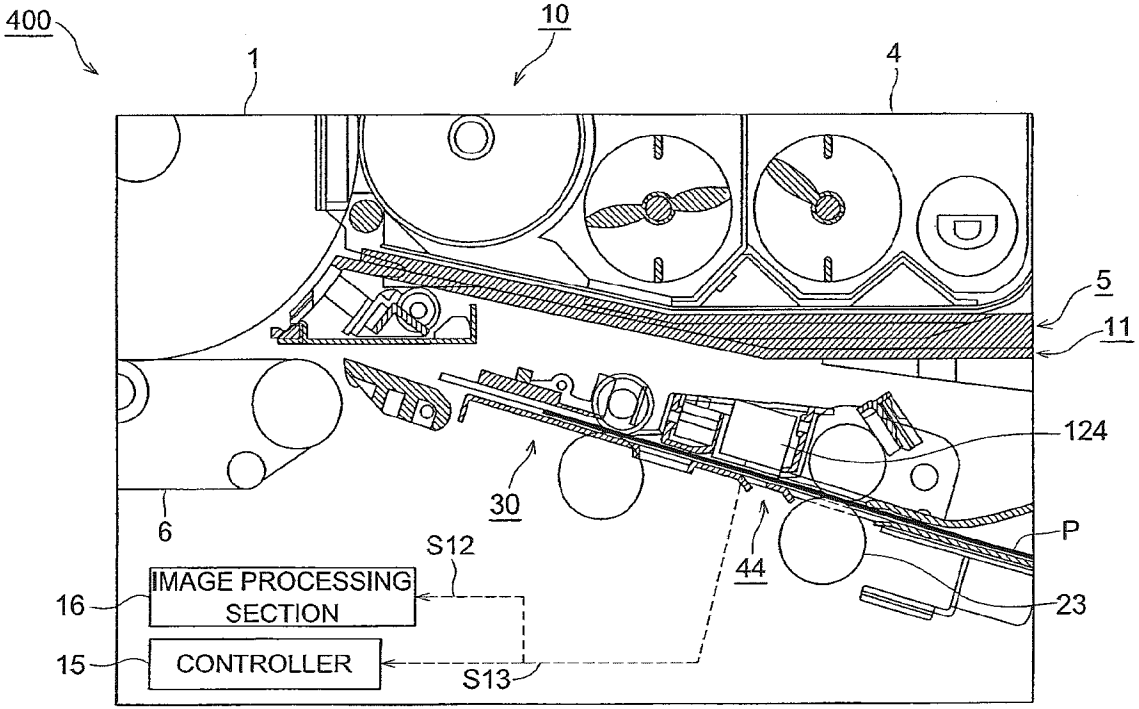
FIG. 9 is a sectional view showing an example of construction of printer 400 serving as the fourth Example.
Figure 10:
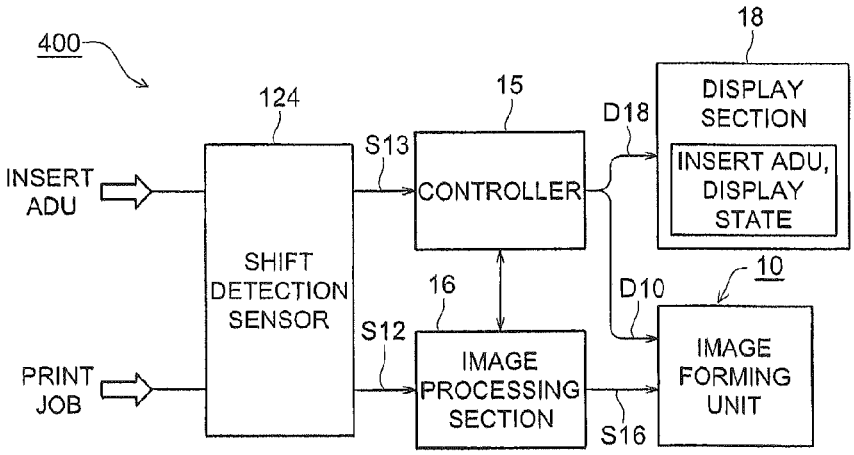
FIG. 10 is a block diagram showing an example of construction of a control system of printer 400.

In this example, shift detection sensor 124 having an insertion monitoring function is connected to controller 15 and to image processing section 16, and it detects an occasion wherein ADU unit 30 is drawn out of process pedestal 11 shown in FIG. 9 and an occasion wherein the ADU unit 30 is installed on process pedestal 11, in the case of mounting and dismounting of ADU unit 30, and it outputs ADU installation presence signals S13 to controller 15. In the case of shift detection, the shift detection sensor 124 detects a sheet conveyance position for sheet P to be conveyed to image forming unit 10 from an unillustrated sheet feeding section by ADU unit 30 shown in FIG. 9, and outputs sheet detection signal S12 to image processing section 16.

For the shift detection sensor 124, a reflection-type optical sensor and a transmission-type optical sensor are used. In general, an optical sensor (including an image sensor such as a line sensor) is composed of a light-emitting element and a light-receiving element.

When a reflection-type optical sensor is used for the shift detection sensor 124 in this example, a light-emitting element and a light-receiving element are arranged on one side of sheet-passing surface I. Therefore, when ADU unit 30 is drawn out of process pedestal 11, a position of a reflection plate that prevents light emitted from a light-emitting element from entering a light-receiving element is needed.

For example, a metallic surface of a supporting member such as a rail extending from process pedestal 11 to be under the area for the shift detection sensor 124 to be attached is utilized as a reflection plate. Due to this, when ADU unit 30 is installed on apparatus main body section 101, light emitted from a light-emitting element is reflected on the metallic surface of the supporting member such as a rail to enter the light-receiving element, which makes operations as a transmission-type optical sensor to be possible. It is recommended to mark an ADU reference position on the metallic surface as a reference position for distinguishing mounting existence of ADU unit 30.

Further, when the transmission-type optical sensor is used for the shift detection sensor 124, a light-emitting element is arranged on the side of the ADU unit 30, for example, and a light-receiving element is arranged on the side of process pedestal 11. When ADU unit 30 is installed on apparatus main body section 101, optical axes agree with each other, and light emitted from a light-emitting element enters a light-receiving element, which makes actions as a transmission-type optical sensor possible. It is recommended that an optical axis of the light-receiving element for an optical axis of the light-emitting element is established as ADU reference position.

When the ADU unit 30 is drawn out of the apparatus main body section 101, an optical axis is shifted and light emitted from a light-emitting element does not enter a light-receiving element, thus, actions as the transmission-type optical sensor become invalid in constitution. Owing to the foregoing, it becomes possible for controller 15 to discriminate between an occasion where the ADU unit 30 has been drawn out of the apparatus main body section 101 and an occasion where the ADU unit 30 has been installed on the apparatus main body section 101, based on ADU installation presence signals S13.

Incidentally, the image processing section 16 inputs sheet detection signal S21 from shift detection sensor 124, and carries out image processing such as extraction of an edge of sheet P, in the same way as in Example 1-Example 3. The image processing section 16 detects a shift of sheet P by image processing such as edge extraction and calculates correction data in the case of start writing images to out them to image forming unit 10. In the image forming unit 10, image information D10 is inputted from controller 15 and writing control signals S16 are inputted from image processing section 16, thus, an image is formed on prescribed sheet P (see FIG. 1). In this example again, display section 18 is connected to controller 15, and the display section 18 inputs display data D18 and displays images of the state of insertion of ADU.

Next, an example of control of printer 400 will be explained as follows, referring to FIG. 11. An assumption in this example is that the shift detection sensor 124 having an insertion monitoring function detects an occasion where ADU unit 30 is drawn out of apparatus main body section 101 shown in FIG. 9 and an occasion where the ADU unit 30 is installed in the apparatus main body section 101, in the case of mounting and dismounting of the ADU unit 30, and outputs ADU installation presence signals S13 to the controller 15.

Figure 11:
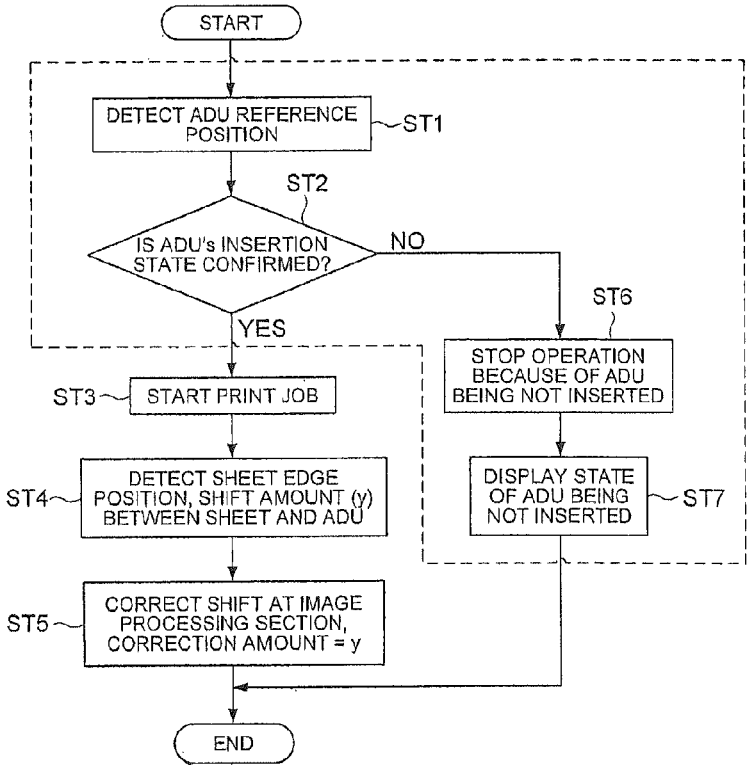
FIG. 11 is a flow chart showing an example of control of printer 400.

Under the control conditions of the foregoing, the shift detection sensor 124 detects the state of installation of ADU unit 30 first and outputs ADU installation presence signals S13 to the controller 15, in step ST1 of a flow chart shown in FIG. 11. When the ADU unit 30 is installed on the apparatus main body section 101, for example, the shift detection sensor 124 outputs ADU installation presence signals S13 at a high level to controller 15, while, when the ADU unit 30 is not installed on the apparatus main body section 101, the shift detection sensor 124 outputs ADU installation presence signals S13 at a low level to controller 15.

Next, in step ST2, the controller 15 forms a judgment (confirms) whether ADU unit 30 is installed on the apparatus main body section 101 or not (the state of installation), based on the ADU installation presence signals S13. For example, the controller 15 compares a comparison reference value (high level) with a level of the ADU installation presence signals S13 to carry out detection of agreement, and when the ADU installation presence signals S13 is at a high level, the controller 15 judges that the ADU unit 30 is installed on the apparatus main body section 101. Further, when the ADU installation presence signals S13 is at a low level as a result of the aforesaid detection of agreement in comparison, the controller 15 judges that the ADU unit 30 is not installed on the apparatus main body section 101.

After the installation of the ADU unit 30 on the apparatus main body section 101 is confirmed, a print job is started in step ST3. In this case, the controller 15 sets image information D10 on writing unit 3. In image forming unit 10, the writing unit 3 stands by for an input of writing control signals S16 coming from image processing section 16. Charging unit 2 electrifies uniformly photoconductor drum 1 that has been cleaned.

Next, in step ST4, the shift detection sensor 124 detects a position of an edge portion of sheet P. In this case, the shift detection sensor 124 outputs sheet detection signals S12 to the controller 15 which, then, calculates shift amount y between sheet P and ADU unit 30 based on sheet detection signal S12. The sheet detection signal S12 that serves as information of an edge position for sheet P is fed back to image processing section 16 by the shift detection sensor 124.

After that, in step ST5, the image processing section 16 carries out shift correction processing to obtain shift amount y which corresponds to correction amount y, and corrects writing control signals S16 with correction amount y. On image forming unit 10, an image is formed based on writing control signals S16. In the image forming unit 10, in this case, writing control signals S16 after correction is inputted from the image processing section 16, and writing unit 13 operates to write an electrostatic latent image on uniformly charged photoconductor drum 1 by irradiating laser beam light having prescribed intensity by image information D10, based on writing control signals S16.

Developing unit 4 develops the electrostatic latent image formed on the photoconductor drum 1 with black toner agents. Transfer unit 7 transfers the toner image formed on the photoconductor drum 1 onto sheet P. Drum cleaner 8 operates to remove toner agents remaining on the photoconductor drum 1 through cleaning. Fixing unit 17 fixes an image that is transferred onto sheet P, and ejects the sheet P after fixing.

In the aforesaid step ST2, the controller 15 judges that ADU unit 30 is not installed on apparatus main body section 101 (un-inserted), when ADU installation presence signals S13 at a low level is inputted from shift detection sensor 124.

In this case, a flow moves to step ST6, and operations of the image forming unit and of an unillustrated sheet-feeding section are stopped by un-inserted ADU unit 30.

After that, a flow moves to step ST7, and the controller 15 displays, on display section 18, display data D18 showing that ADU unit 30 is not inserted. The display section 18 inputs the display data D18, and displays character information such as "State of ADU insertion is imperfect." and icon images of ADU unit 30 showing imperfect state for insertion of ADU. In this case, it is also possible to output from a speaker that does not illustrate a voice guide such as "State of ADU insertion is imperfect".

As stated above, in printer 400 representing the fourth example, shift detection sensor 124 having insertion monitoring function is provided, and it detects an occasion wherein ADU unit 30 is drawn out of apparatus main body section 101 shown in FIG. 9, and it detects an occasion wherein ADU unit 30 is installed, in the case of dismounting and mounting of ADU unit 30, and ADU installation presence signal S13 is outputted to the controller 15.

Therefore, it makes it possible for the controller 15 to judge whether ADU unit 30 has been drawn out of apparatus main body section 101 or the ADU unit 30 has been installed in the apparatus main body section 101, based on ADU installation presence signals S13. Though the conventional method has therein a sensor to confirm exclusively the state of insertion and locking of ADU unit 30 separately, shift detection sensor 124 has also the function to monitor the insertion in the present invention, thus, it is possible to achieve cost reduction in an amount equivalent to the cost of an exclusive sensor.

Although the explanation has been given for the printer (printing machine) for black-and-white images concerning an image forming apparatus in the aforesaid example, the invention is not limited to this, and the same effects can be obtained even when the invention is applied to a printer (printing machine) for color images, copying machines for black-and-white images and color images and to a multifunction peripheral having functions of the printer and the copying machine.

Further, though the explanation has been given for sheet P concerning sheets, the invention is not limited to this, and the same effects can be obtained even when the invention is applied to a resin substrate, a film and a laminated sheet.

In the embodiment of the image forming apparatus of the invention, a relationship of relative positions between an image forming section and a sheet detection section can be maintained to be constant. Therefore, even in the case where a position for installation of a sheet conveyance section for the apparatus main body is scattered in the case of jamming clearance for paper jam, a position of image writing in the image forming section can be corrected with a higher degree of accuracy, in comparison with a conventional mode. In addition, even when a positional shift is caused between the apparatus main body section and the sheet conveyance section, by the error of mounting of the sheet conveyance section on the apparatus main body section in the case of maintenance or the like, readjustment for image position correction is not needed.

In the embodiment of the image forming apparatus of the invention, when the sheet conveyance section is mounted on the apparatus main body section, a sheet detection section is brought into contact with a projection member, thus, a relationship of relative positions between an image forming section attached on the apparatus main body section and a sheet detection section attached on the sheet conveyance section can be maintained to be constant.

In the embodiment of the image forming apparatus of the invention, it is possible to carry out an arithmetic processing to subtract an error of mounting a sheet conveyance section on the apparatus main body section from information of a position of the sheet detected by the sheet detection section. Therefore, a positional shift caused unwillingly between an image forming section and a sheet detection section can be corrected.

Owing to the foregoing, even when a position for installation of a sheet conveyance section on the apparatus main body section in the case of jamming clearance or the like is scattered, it is possible to correct a writing position for an image on the image forming section with a higher degree of accuracy, in comparison with a conventional mode. In addition, even when a positional shift is caused between an apparatus main body section and a sheet conveyance section is caused by an error of attaching a sheet conveyance section on the apparatus main body in the case of maintenance work or the like, it is not necessary to adjust again for correction of image positions.

The present invention can be applied extremely favorably to a printer (printing machine), a copying machine and a multifunction peripheral having functions of the printer and the copying machine, each being equipped with a function where an image shifting is not caused even in the case wherein an ADU unit is drawn out of the apparatus main body section in the case of jamming clearance or maintenance work, and the ADU unit is installed on the apparatus main body section again.

What is claimed is:

1. An image forming apparatus comprising:

(a) an apparatus main body;

(b) an image forming section attached on the apparatus main body, having a drum cartridge which includes an image carrier, a writing unit which forms an electrostatic latent image on the image carrier based on image information and a developing unit which develops the electrostatic latent image formed on the image carrier, and a transfer section which transfers the developed image onto a sheet;

(c) a sheet conveyance section, detachably attached on the apparatus main body, which conveys a sheet to the image forming section;

(d) a position reference section provided on the sheet conveyance section;

(e) a sheet detection section attached on the sheet conveyance section, which detects a position of an edge portion of the sheet that is conveyed to the image forming section;

(f) a position reading section attached on the drum cartridge, which reads a position of the position reference section; and (g) a position correction section which corrects information of an image writing position for an image to be written by the writing unit based on reference position information obtained from the position reading section, and information of the position of the edge portion of the sheet detected by the sheet detection section, wherein the writing unit and the position reading section are attached on the same drum cartridge, and the writing unit writes an image on the image carrier based on the information of the image writing position for the image which has been corrected by the position correction section.

2. The image forming apparatus of claim 1, wherein the sheet detection section detects a shift of the sheet in a direction perpendicular to a sheet conveying direction.

3. The image forming apparatus of claim 1, wherein the position reading section is a CCD image pickup device.

4. An image forming apparatus comprising:

(a) an apparatus main body;

(b) an image forming section that is attached on the apparatus main body, having a drum cartridge which includes an image carrier, a writing unit which forms an electrostatic latent image on the image carrier based on image information, and a developing unit which develops the electrostatic latent image formed on the image carrier, and a transfer section which transfers the developed image onto a sheet;

(c) a sheet conveyance section detachably attached on the apparatus main body, which conveys a sheet to the image forming section;

(d) a sheet detection section attached on the sheet conveyance section, which detects a position of an edge portion of the sheet that is conveyed to the image forming section;

(e) a position reference section provided on the drum cartridge;

(f) a position reading section that is attached on the sheet conveyance section on which the sheet detection section is attached, which reads a position of the position reference section; and (g) a position correction section which corrects information of an image writing position for an image to be written by the writing unit based on reference position information obtained from the position reading section, and information of the position of the edge portion of the sheet detected by the sheet detection section, wherein the writing unit writes an image on the image carrier based on the information of the image writing position for the image which has been corrected by the position correction section.

5. The image forming apparatus of claim 4, wherein the sheet detection section detects a shift of the sheet in a direction perpendicular to a sheet conveying direction.

6. The image forming apparatus of claim 4, wherein the position reading section is a CCD image pickup device.

* * * * *